166-274 SR
4/28/87 XR 4,660,641

United States Patent [19]
Shen

[11] Patent Number: 4,660,641
[45] Date of Patent: Apr. 28, 1987

[54] BUFFERED STEAM DRIVE OIL RECOVERY PROCESS

[75] Inventor: Chin W. Shen, Houston, Tex.

[73] Assignee: Texaco Inc., White Plaines, N.Y.

[21] Appl. No.: 772,115

[22] Filed: Sep. 3, 1985

[51] Int. Cl.[4] ..... E21B 43/24
[52] U.S. Cl. ..... 166/272; 166/274; 166/303
[58] Field of Search ..... 166/271, 272, 273, 274, 166/303, 305.1

[56] References Cited

U.S. PATENT DOCUMENTS

| | | | |
|---|---|---|---|
| 3,279,538 | 10/1966 | Doscher | 166/272 |
| 3,880,237 | 4/1975 | Snavely, Jr. et al. | 166/303 |
| 3,913,671 | 10/1975 | Redford et al. | 166/272 |
| 3,924,683 | 12/1975 | George et al. | 166/303 |
| 3,977,470 | 8/1976 | Chang | 166/273 |
| 4,068,716 | 1/1978 | Allen | 166/272 X |
| 4,487,262 | 12/1984 | Venkatesan et al. | 166/272 X |
| 4,523,642 | 6/1985 | Venkatesan | 166/272 |

*Primary Examiner*—George A. Suchfield
*Attorney, Agent, or Firm*—Jack H. Park; Kenneth R. Priem

[57] ABSTRACT

Steam injected into a subterranean formation comprises a liquid phase and a vapor phase. Oil displacement by the liquid phase is not as efficient as the oil displacement in the portion of the formation contacted by the vapor phase. The effectiveness of the oil recovery process in the portion of the formation being contacted by the liquid phase is increased by contacting that portion of the formation with an aqueous solution containing from 0.005 to 2.0 percent by weight of an alkalinity agent, preferably sodium hydroxide, and from 0.01 to 5.0 percent by weight of a buffering agent, preferably sodium carbonate. The mixture of sodium hydroxide and sodium carbonate may be co-mixed with the steam introduced into the formation, or may be introduced as a separate liquid containing both the sodium carbonate and sodium hydroxide, or separate slugs containing sodium carbonate and sodium hydroxide may be injected.

7 Claims, 4 Drawing Figures

BUFFERED STEAM DRIVE OIL RECOVERY PROCESS

FIELD OF THE INVENTION

This invention relates to a method for recovering petroleum from subterranean deposits thereof. More specifically, this method involves a method for recovering relatively viscous petroleum from subterranean deposits by application of a buffered steam drive process. Still more specifically, this invention involves introducing an aqueous drive fluid, usually steam comprising a gaseous phase which is essentially pure water vapor and a liquid phase which is essentially hot water containing a mixture of an alkalinity agent and a buffering agent to increase the oil recovery effectiveness of the liquid phase portion of the steam injected into the subterranean formation.

BACKGROUND OF THE INVENTION

There are many subterranean reservoirs which contain petroleum the viscosity of which is so great that relatively minor amounts thereof can be recovered from a formation by so called primary recovery. Many processes have been described in the prior art for increasing the recovery of viscous petroleum from these formations, and a few have been successfully applied on a commercial basis. Steam flooding is the most successful method utilized commercially for this purpose, and there are numerous commercial steam flood operations on-going at the present time. While steam flooding has been effective for recovering a significant amount of otherwise unrecoverable viscous petroleum from subterranean formations, it is not entirely satisfactory, especially in certain situations. In a conventional steam drive process, a number of injection wells and a number of spaced apart production wells are drilled into the formation, and steam is injected into the injection wells to displace petroleum essentially laterally through the formation toward the production wells. The steam that is injected into the formation is usually a two phase mixture, comprising a vapor phase and a liquid phase. Because of the significant difference in the specific gravity or density of these two phases, the vapor phase portion of the steam migrates fairly quickly to the upper portion of the subterranean petroleum containing formation, and essentially all of the hot liquid phase portion of the steam migrates into the bottom portion of the formation. Vapor phase steam is more effective than hot water at displacing viscous petroleum, and so the portion of the formation swept by the steam is desaturated to a greater extent than the portion of the formation swept by the liquid phase steam condensate.

The addition of chemicals to the steam for the purpose of increasing the oil recovery effectiveness of the liquid phase condensate portion of the steam oil recovery fluid has been recognized, and numerous prior art references to be discussed below have disclosed various additives for this purpose. None have proven to be entirely satisfactory, however, and one common problem which reduces the effectiveness of many of the additives which are coinjected with the steam or other oil displacement fluid is the tendency for the formation mineral matrix to absorb the added chemicals, thereafter rendering them ineffective for the purpose of increasing the oil displacement efficiency of the liquid phase portion of the steam. Because of the relatively large amount of petroleum remaining in the formation after termination of a steam drive oil recovery process, there is a significant unfulfilled need for an additive for steam which will improve the oil displacement efficiency of the liquid phase portion of steam over that realized by application of prior art process.

DESCRIPTION OF PRIOR ART

The following references show the state of the art utilizing additives for water or steam which are related to the present process.

U.S. Pat. No. 1,651,311, Howard Atkinson, Nov. 29, 1927 describes a method for recovering petroleum comprising injecting water having dissolved therein a strong alkali.

U.S. Pat. No. 3,191,676, H. Robert Froning, June 29, 1965, describes an oil recovery process using ambient temperature water containing a mixture of water-soluble carbonates and water-soluble phosphate salts.

U.S. Pat. No. 3,490,532, Joseph T. Carlin, Jan. 20, 1970, describes a method for recovering viscous petroleum by injecting an ambient temperature aqueous fluid containing a alkalinity agent such as an alkali metal hydroxide and a solublilizing agent such as quinoline to emulsify the viscous petroleum.

U.S. Pat. No. 3,687,197, David A. Redford, Aug. 29, 1972, describes a method for recovering viscous petroleum including bitumen from tar sand deposits by injecting a hot aqueous solution containing a caustic material dissolved therein.

U.S. Pat. No. 3,690,376, R. W. Zwicky and Robert M. Gies, Sept. 12, 1972, describes an oil recovery process involving injection of steam containing an alkali metal carbonate and a sequestering agent such as alkali metal sulfates, sulfites, polyphosphates, polyamine polyacetyate and the like.

U.S. Pat. No. 3,853,178, C. W. Shen, Dec. 10, 1974 describes a steam displacement oil recovery method employing steam containing a very small amount of caustic material such as sodium hydroxide.

U.S. Pat. No. 4,223,730, Walther Schulz and Wilhelm Gebetsberger, Sept. 23, 1980, describes a method for recovering petroleum by flooding with hot water containing an alkali such as sodium hydroxide.

U.S. Pat. No. 4,441,555, W. R. Shu, Apr. 10, 1984, describes an oil recovery method using hot water saturated with carbon dioxide and containing a $CO_2$ solubility promoter such as sodium hydroxide or sodium carbonate.

U.S. Pat. No. 2,813,583, J. W. Marx and H. W. Parker, Nov. 19, 1957, describes a method for recovering petroleum by injecting hot water or steam containing sufficient alkalinity agent to raise the pH of the treating fluid to a value greater than 7.5, the alkalinity agent being preferably ammonia or alkali metal compound such as hydroxide or carbonates.

U.S. Pat. No. 3,279,538, T. M. Doscher, Oct. 18, 1966, describes an oil recovery method involving injection of a very dilute aqueous alkaline solution and steam in combination.

SUMMARY OF THE INVENTION

My invention concerns an improvement in steam flooding, specifically a steam drive oil recovery process, in which steam is coinjected with an aqueous solution containing a mixture of an alkaline metal hydroxide, preferably sodium hydroxide or other alkaline materials such as sodium silicate or sodium orthosilicate, and as a buffering agent, sodium carbonate or sodium bicarbonate. The ratio and concentration of these chemicals is critical and when used in the proper ratio result in a buffered solution, i.e. one in which the pH changes only slowly as the alkaline earth hydroxide is absorbed from the aqueous solution by the formation matrix. The sodium hydroxide or other alkalinity agent and sodium carbonate may be injected in the desired ratio and concentration on a continuous basis as steam is injected into the formation, or separate aqueous slugs of these materials may be injected in a sequential manner during the course of steam injection, in order to accomplish mixing of the alkaline agent and carbonate in the desired ratio which produces the buffered solution in the liquid phase component of the injected steam. Sodium hydroxide reduces the interfacial tension between oil and water and reverses the formation wettability from oil wet to water wet. The presence of sodium carbonate in the critical ratio greatly reduces the rate of absorption of sodium hydroxide from the liquid phase, so the interfacial tension reduction effect persists for much longer periods of time as the steam condensate displacement progresses through the formation.

DESCRIPTION OF PREFERRED EMBODIMENTS

Figure 1:
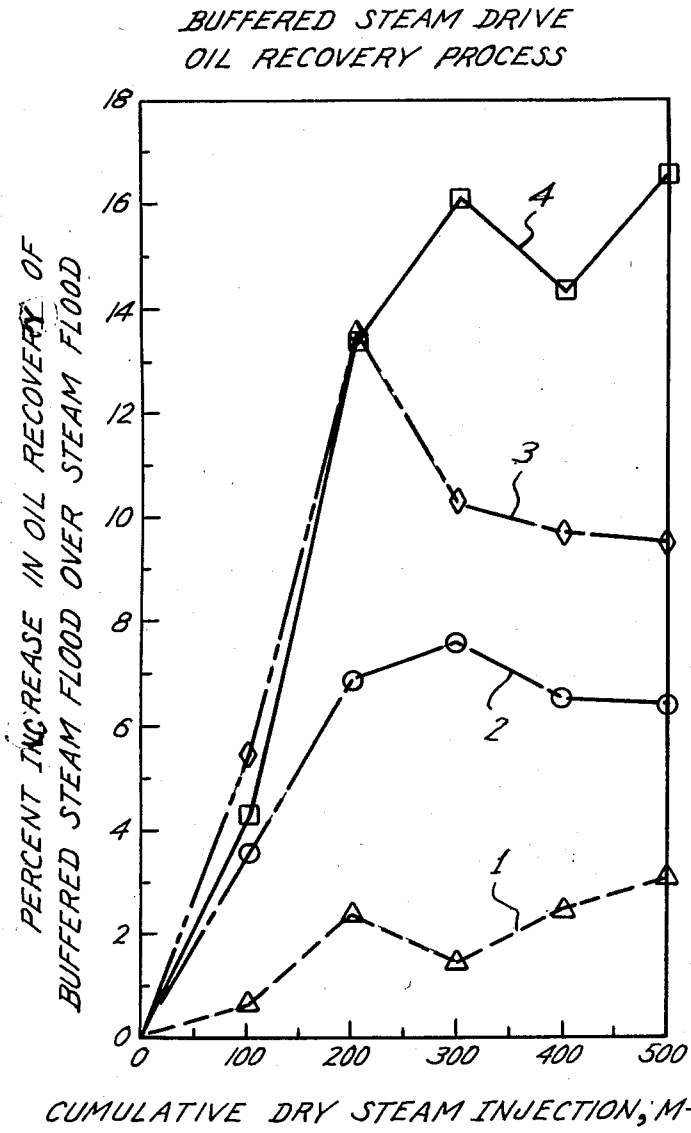
FIG. 1 illustrates graphically the percent increase in oil recovery accomplished by the use of steam containing sodium carbonate alone in several concentrations, sodium hydroxide when used alone, and the desired critical ratio of sodium carbonate and sodium hydroxide which produces the buffered steam drive process according to the process of my invention.

My invention is concerned with an improvement in steam flooding or steam drive oil recovery processes, of the type wherein steam comprising both a vapor phase and a liquid phase are injected into a portion of the oil-containing formation. Because of the differences in specific gravity, steam vapor migrates to the upper portion of the formation and the liquid phase is confined in the lower portion of the formation. The vapor phase of steam is more effective for displacing petroleum, and the liquid phase portion occupying the bottom of the formation does not displace petroleum as well as would be desired. This phenomenon is especially detrimental to the oil recovery effectiveness when the flooding technique is a steam drive in which the two-phase steam is injected into a formation by an injection well, with the steam displacing petroleum through a substantial distance at an essentially horizonal direction, which gives the injected steam sufficient time to separate into liquid and vapor phases. This produces the effect referred to as steam override, in which significant portions of the formation are contacted by two distinctly different phases. The upper portion of the formation is swept almost entirely by vapor phase steam, and the bottom portion of the formation is swept almost entirely by liquid phase hot water. As steam vapor migrates more rapidly through the formation than liquid, and as the stripping of petroleum progresses through the upper portion of the formation, desaturation of the formation results in a dramatic increase in the permeability of the portion of the formation which has been swept by the steam vapor. Once steam vapor break-through occurs at the production well, subsequently injected steam moves rapidly through the upper portion of the formation which has already been swept and desaturated of petroleum by the steam vapor, with a very little additional displacement occurring in the bottom portion of the formation. The result is that a significant amount of petroleum is not recovered from the recovery zone of the formation. Once this condition has progressed to the above-described level, there is no treatment known which effectively permits sweeping the bottom portion of the formation in order to recover the unrecovered petroleum. Accordingly, the improvement which increases the effectiveness of the displacement of petroleum in the lower portion of the formation by the liquid phase hot water must be applied early in the steam drive process in order to avoid reaching the above-described condition in which the high permeability steam swept zone is created above the lower portion of the formation. Accordingly, it is an objective of my invention to improve the oil recovery efficiency in the portion of the formation swept by steam condensate, i.e. the lower portion of the formation which is normally only contacted by steam condensate or hot liquid phase water. This is accomplished by incorporating an additive in the steam or introducing it into the formation separately which is principally confined to the liquid phase portion thereof, which reduces the interfacial tension between oil and water and reverses the formation wettability from oil wet to water wet.

Although the addition of various chemicals to steam as described in prior references has been shown to increase the displacement efficiency in laboratory scale tests, the use of sodium hydroxide, for example, as an additive for steam in commercial use has not been entirely effective because the excessive absorption of sodium hydroxide from the liquid phase solution by formation surfaces, e.g. rock formation surfaces, removes the interfacial tension reducing additive from the flood long before it has progressed a significant distance away from the injection well into the formation. This adverse affect of absorption of sodium hydroxide cannot effectively be offset by increasing the concentration of sodium hydroxide, since very high concentrations of sodium hydroxide promote rapid formation of an emulsion which adversely affects the permeability of the formation to the flow of fluids therethrough.

I have discovered that the effectiveness of an alkalinity agent such as an alkali metal hydroxide, specifically and preferably sodium hydroxide, can be greatly enhanced if a buffering agent is added to the injected oil displacing fluid. I have found that sodium carbonate or sodium bicarbonate, if mixed with sodium hydroxide in a critical ratio, produces a buffered solution which greatly extends the effectiveness of sodium hydroxide component of the displacing fluid as the fluid passes through the formation.

In its broadest aspect, the present invention contemplates that the portion of the formation to be contacted by the liquid phase component of the aqueous displacing fluid, e.g. the steam condensate phase of steam, will also be contacted by a mixture of sodium carbonate ($Na_2CO_3$) and sodium hydroxide (NaOH) in the preferred embodiment. The main purpose of the alkalinity agent, e.g. the sodium hydroxide, is to control the pH and function as an interfacial tension reducer so the displacement of oil by water is more effective, e.g. is a low surface tension displacement process. The main function served by the buffering agent, e.g. the sodium carbonate, is to buffer the solution, that is to insure that the pH changes very slowly as the alkalinity agent reacts as intended, or as it is absorbed from solution by the formation mineral matrix. Sodium carbonate also provides a source of sodium ions to exchange with hydrogen ions on the clay surfaces (instead of hydroxide ions) and also serves to remove calcium ions from the clay surface. The presence of sodium carbonate will hold down the reactivity of the alkalinity agent, the sodium hydroxide in the preferred embodiment, so less sodium hydroxide is consumed by unproductive reactions, making more sodium hydroxide available for reaction with the crude oil in its beneficial effect, that of reducing interfacial tension between the aqueous displacing phase and the formation petroleum. I have found that losses of sodium carbonate by absorption are essentially negligible in oil saturated sands and similar formation matrixes, whereas the loss of sodium hydroxide when used alone is significant and fairly rapid. When the two are used together in a critical ratio as disclosed herein, I have discovered that the loss of sodium hydroxide is reduced significantly as a consequence of the presence of sodium carbonate.

In the practice of my invention, it is contemplated that at least one component from each of two groups described below will be present in an aqueous solution form, either by incorporatin them directly in the aqueous liquid phase of the displacing fluid, e.g. the condensate portion of the injected steam, or in one or more separate aqueous slugs to be injected sequentially with the injection of steam.

The first component required is an alkalinity agent, and the preferred alkalinity agents are the alkali earth metal hydroxide such as sodium hydroxide, potassium hydroxide or lithium hydroxide. Other alkalinity agents such as sodium silicate, sodium orthosilicate or mixtures of these can also be used. Clearly the especially preferred alkalinity agent is sodium hydroxide, primarily because of its effectiveness, availability and low cost.

The buffering agent should be an alkali earth carbonate such as sodium carbonate, although sodium bicarbonate may also be used. Sodium carbonate is believed to be more effective than sodium bicarbonate for this purpose, and in view of its effectiveness and low cost, it is clearly the preferred buffering agent for the process of my invention.

The concentration of the buffering agent, preferably sodium carbonate, as used in the process of my invention is from 0.01 percent to 5.0 percent by weight, and preferably is in the range from 0.02 to 4.0 percent by weight. The concentration of sodium hydroxide or other alkalinity agent should be in the range from about 0.005 percent by weight to about 2.0 percent by weight, and preferably in the range of from 0.01 to 1.9 percent by weight. The ratio of the buffering agent concentration to the alkalinity agent concentration should be in the range of from about 0.01 to about 400 and preferably in the range of from 0.02 to 200. The especially preferred ratio is from 0.5 to 20.

The benefit of the process of my invention is achieved by contacting at least a portion of the lower portion of the formation which is to be contacted by the liquid phase or condensate portion of the injected steam, with a mixture of sodium carbonate and sodium hydroxide. The benefits described herein will not be achieved if the alkalinity agent-buffer contacts the formation substantially after the liquid phase displacing agent has passed through the formation. The best results are obtained if the contact between the buffered alkalinity agent and the formation occurs prior to or essentially simultaneously with initial contact between the hot condensate steam phase and the formation. There are several ways to accomplish the desired contact. One especially preferred embodiment of my invention involves adding the alkalinity agent and buffering agent to steam on an essentially continuous basis, at least in the initial period of steam injection into a formation. Thus one embodiment of my invention involves injecting from 0.05 to 3.5 and preferably 0.05 to 1.0 pore volumes of steam into a region of a formation in which steam displacement is to be performed, which pore volume of steam contains from 0.005 to 2.0 and preferably, 0.01 to 1.9 percent of sodium hydroxide or other alkalinity agent and from 0.01 to 5.0 and preferably from 0.02 to 4.0 percent by weight of the sodium carbonate or other buffering agent. After injection of this amount of steam containing the sodium carbonate and sodium hydroxide has been completed, injection of steam without alkalinity agent or buffering agent may then be continued until termination of steam flood.

In another embodiment of the process of my invention, a slug of water, which may be heated or essentially surface ambient temperature water, containing from 0.005 to 2.0 percent by weight alkalinity agent and from 0.01 to 5.0 percent by weight buffering agent may be injected into the formation in slugs comprising from 0.0001 to 0.5 pore volumes, with from 0.0001 to 3.5 pore volumes of steam being interjected intermittently therebetween. Alternating injection of an aqueous solution of sodium hydroxide and sodium carbonate with intermittent injection of untreated wet steam is continued until from about 0.0001 to about 3.0 pore volumes of total fluid injection has occurred, after which untreated wet steam injection may be applied more or less continually until the desired total amount of fluid has been injected into the formation, or until the ratio of oil to water of the fluid being recovered from the production well drops to a predetermined level.

In another variation, one or more slugs of sodium hydroxide and one or more separate slugs of sodium carbonate may be injected, followed by steam injection, rather than injecting one or more aqueous slugs containing a mixture of sodium hydroxide and sodium carbonate. The chemicalized slug injection can otherwise parallel the second embodiment described above, with intermittent injection of steam, sodium carbonate solution slug, sodium hydroxide solution slug, repeating until from 0.001 to 3.5 pore volumes of fluid have been injected into the formation.

Combinations of the above embodiment are also within the contemplation of the process of my invention, such as first injecting a slug containing a mixture of sodium hydroxide and sodium carbonate followed by steam injection, followed by an aqueous slug of sodium carbonate, followed by a separate slug of sodium hydroxide, alternating thereafter with steam and slugs of treating fluid. With all of the embodiments contemplated for use in the process of my invention, it is intended that the injected primary oil displacement fluid should be wet steam whose steam quality is anywhere between 0 (essentially hot water) to 99 percent which would be mostly vapor phase steam. As used in this context, 30% quality steam means a two-phase fluid containing 30 percent vapor by weight and 70 percent liquid phase hot water by weight. Ordinarily, the preferred steam quality for use in the process of my invention is in the range of from about 0.0 to 99.0 and especially preferred range is from 0.0 to 75.0 percent by weight.

Although most of the disclosure of the means of applying specific embodiments of the process of my invention involve steam drive or through-put processes in which steam is injected into the formation by via at least one injection well on a more or less continuous basis to displace petroleum through the formation to at least one spaced-apart production well, clearly the benefits of the process of my invention may also be realized in a push-pull or single well steam stimulation technique, in which steam, sodium hydroxide and sodium carbonate in the quantities discussed above are injected into a formation, followed by a soak, if desired, followed by recovery of the injected fluids together with oil mobilized by the injected fluid is accomplished from the same well as was used for injection of the various fluids.

For the purpose of illustrating the benefits that can be realized by application of various embodiments of the process of my invention, the following experiments were performed as will be described in detail below.

EXPERIMENTAL SECTION

A series of experiments were performed to verify that absorption of sodium hydroxide by a typical oil-containing formation specimen is high for sodium hydroxide, much less for sodium carbonate, and that the presence of sodium carbonate will reduce the amount of sodium hydroxide absorbed from an aqueous solution on contact with earth formation. Aqueous solutions of sodium hydroxide and sodium carbonate, alone and in combination, were flowed through a formation core sample obtained from the Kern River field located in California. The concentration of sodium hydroxide and sodium carbonate in the effluent exiting from the cell was determined after passage of up to seven pore volumes of fluid through the pore sample. The data contained in Table I below illustrate the observed concentrations. It should be understood that a low concentration in the effluent indicates a high absorption of either sodium carbonate or sodium hydroxide. In this table, Fluid 1 is water containing 0.24 percent sodium carbonate with no sodium hydroxide. Fluid 2 is water containing 0.08 percent sodium hydroxide plus 0.24 percent sodium carbonate. Fluid 3 is water containing 0.8 sodium hydroxide plus 0.24 percent sodium carbonate and Fluid 4 is water containing 0.08 percent sodium hydroxide with no sodium carbonate.

TABLE I

| Pore Volumes of Injected Fluid | Chemical Concentration in Effluent (% of Injected Concentration Fluid) 1 | 2 | 3 | 4 |
|---|---|---|---|---|
| 1 | 90 | 90 | 0 | 0 |

TABLE I-continued

| Pore Volumes of Injected Fluid | Chemical Concentration in Effluent (% of Injected Concentration Fluid) 1 | 2 | 3 | 4 |
|---|---|---|---|---|
| 3 | 100 | 95 | 30 | 0 |
| 5 | 100 | 95 | 50 | 25 |
| 7 | 100 | 100 | 75 | 38 |

It can be seen from the above that sodium hydroxide was absorbed to a very great degree by this formation rock sample, whereas sodium carbonate was not. The fluids containing a mixture of sodium carbonate with sodium hydroxide resulted in a very low absorption rate of both chemicals, indicating that the presence of sodium carbonate greatly reduced the rate of absorption of sodium hydroxide.

In another experiment, a laboratory model was constructed to represent an aerial physical model scaled to simulate a quarter of a two-and one-half acre, 88 foot thick confined five spot pattern, utilizing Ottwa sand as the formation mineral matrix. The model was saturated with Kern River Field (California) water and crude oil to an initial oil saturation of 63.6 percent. Softened Kern River Field water was used for generating 70 percent quality steam. The steam injection rate was maintained at a value equivalent to a field injection rate of about 300 barrels per day of dry steam (100% vapor). Sodium carbonate, sodium hydroxide and mixtures thereof were used as additives in the steam flood. A steam flood with no additive was performed first, and the oil recovery at various steam injection volume values was determined. The subsequent tests, the data for which are plotted in FIG. 1 hereof, report the steam production as a percent increase in oil recovery (over the recovery obtained in the steam flood with no additives) of the buffered steam flood as well as the steam flood utilizing sodium carbonate alone and sodium hydroxide alone. Inspection of the data represented graphically in FIG. 1 indicate that while both steam plus 500 ppm sodium hydroxide (Curve 3) and steam plus 500 ppm and 1,000 ppm sodium carbonate (Curves 1 and 2) increased the amount of oil recovered over an untreated steam flood, the amount of oil recovered using steam containing a mixture of 250 ppm sodium carbonate and 500 ppm sodium hydroxide (Curve 4), in accordance with the teachings of this invention, are clearly superior to that obtained using either the untreated steam, or steam containing sodium hydroxide or steam containing sodium carbonate. These data clearly indicate that the process of my invention produces a result which is significantly and surprisingly greater than that obtained using steam and either of the components of the buffered solution of the process of my invention alone.

Another series of experiments was conducted using short linear cores which contained Kern River Formation material premixed with crude oil. The mixture of formation material and crude oil were introduced into a lead sheath 1.5 inches in diameter and 2.5 inches long. The core was inserted in a rubber sleeve and mounted vertically in a Hassler core holder. A manually operated hydraulic pump was used to apply confining pressure by compressing the rubber sleeve against the core. Temperature of the injected water at the point of entry into the core was 250° F. and temperature of the produced liquids varried between 150° F. and 170° F. at the end of the experiment.

Figure 2:
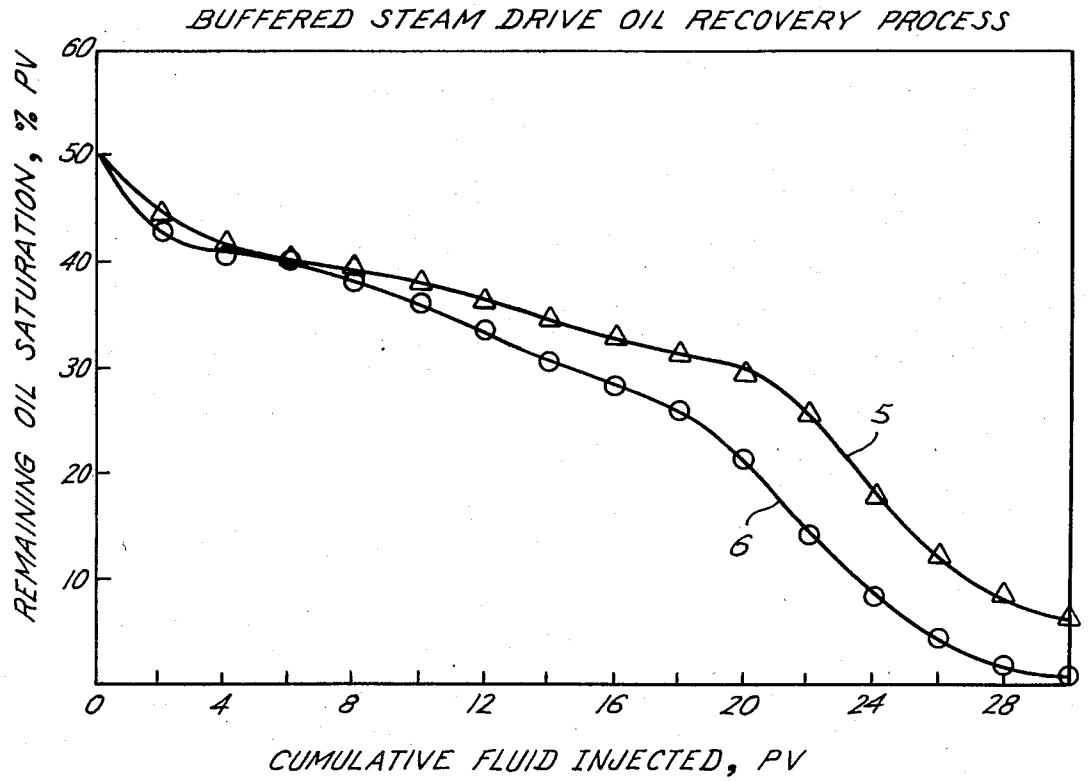
FIG. 2 illustrates a variation in the process of my invention in which a hot water flood is applied to an oil containing formation, with the first portion of the hot water flood utilizing hot water containing only sodium hydroxide, and the subsequent portions containing both sodium carbonate and sodium hydroxide.

Two runs were made utilizing the cores prepared as is discussed above. In the first, the core was flooded with 20 pore volumes of 0.16 percent sodium hydroxide solution which reduced the oil saturation from 50.4 percent initially to 30 percent. Subsequent injection of 0.32 percent sodium carbonate with 0.08 percent sodium hydroxide for an additional ten pore volumes reduced the saturation from 30 percent to 6.5 percent. These results are designated by a curve 5 in FIG. 2.

In a second run, the core was first flooded with hot water containing 0.12 percent sodium hydroxide until 18 pore volumes had been introduced, after which a hot water flood containing 0.24 percent sodium carbonate and 0.08 percent sodium hydroxide was begun. The results, designated as Curve 6 in FIG. 2, clearly indicate that essentially all of the oil present in the core was obtained in this manner.

Figure 3:
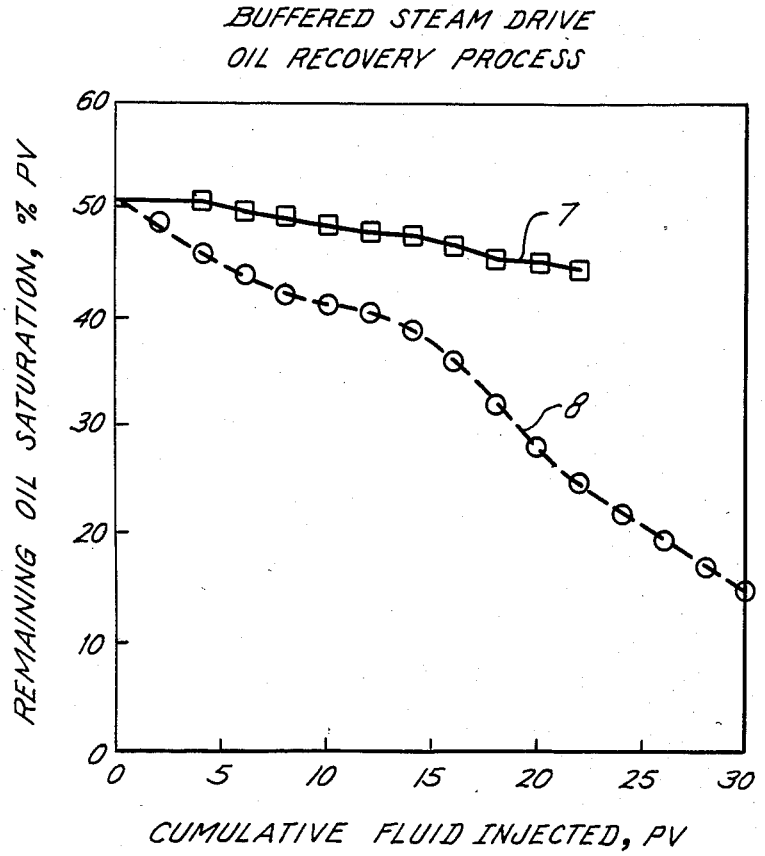
FIG. 3 illustrates the effect of temperature on a water flood displacement process utilizing sodium hydroxide and sodium carbonate in the ratio which produces buffered solution necessary to achieve the results described herein.

Another series of experiments was performed to determine whether the benefits of utilizing an aqueous fluid containing sodium carbonate and sodium hydroxide could be obtained when the injected fluid was unheated, essentially at ambient temperature. A water flood with ambient temperature water containing 0.16 percent sodium carbonate until 15 pore volumes of fluid had been injected followed by an injection of water containing 0.4 percent sodium carbonate resulted in reducing the oil saturation from slightly over 50 percent to only about 46 percent, as is shown by Curve 7, on FIG. 3. An essentially identical flood performed using fluids heated to 250° F. is shown in Curve 8, and as can be seen, the hot water buffered alkaline flood produced a surprisingly greater reduction in residual oil saturation than the unheated fluid. Accordingly, the process of this invention appears to be effective only when used in a hot aqueous fluid flood.

A series of experiments was performed to determine the effect of varying the concentration of both sodium carbonate and sodium hydroxide in floods employing hot aqueous solutions containing both sodium carbonate and sodium hydroxide. The results of these tests is shown graphically in FIG. 4, where it can be seen that for each concentration, there was a critical ratio of sodium carbonate and sodium hydroxide, as is evidenced by the minimum value of remaining oil saturation after 10 pore volumes of chemical injection. The concentrations of sodium carbonate in the various floods was as follows: 0.16% for Curve 9; 0.24% for Curve 10; 0.32% for Curve 11; 0.4% for Curve 12 and 0.48% for Curve 13. Clearly, the best results are obtained utilizing 0.24 percent sodium carbonate and 0.12 percent sodium hydroxide. These results clearly indicate that there is a synergistic reaction between sodium carbonate and sodium hydroxide when employed in the process of my invention. There is a minimum oil saturation, and hence an optimum result, for each concentration of sodium carbonate. The optimum sodium hydroxide concentration became smaller as the amount of sodium carbonate employed was increased. A fairly wide range of combinations of sodium carbonate and sodium hydroxide exists which provides effective oil mobilization and subsequent recovery.

Figure 4:
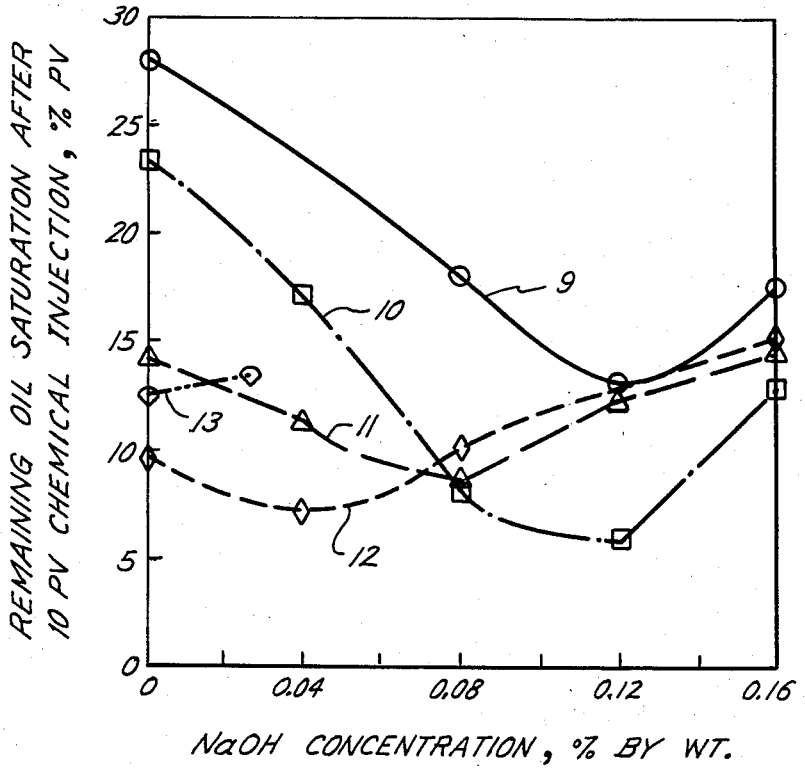
FIG. 4 illustrates the effect of varying the concentration of sodium carbonate and sodium hydroxide independently in a hot water flood oil recovery process.

Inspection of the curves in FIG. 4 indicate that opitmum results were obtained using the following concentrations:

TABLE II

| Curve No. | $Na_2CO_3$ (%) | NaOH Conc. (%) | % $NA_2CO_3$ Ratio % NaOH |
|---|---|---|---|
| 9 | 0.16 | 0.09–0.15 | 1.77–1.06 |
| 10 | 0.24 | 0.06–0.15 | 4.0–1.60 |
| 11 | 0.32 | 0.04–0.14 | 8.0–2.29 |
| 12 | 0.40 | 0.01–.06 | 40.0–6.66 |
| 13 | 0.48 | N/A N/A | |

Based on the above data, it can be seen that the $Na_2CO_3$/NaOH ratio should be between 1 and 8 and preferably between 1 and 2 when the $Na_2CO_3$ concentration is from about 0.12 to about 0.2%; from 1.6 to 4 when the $Na_2CO_3$concentration is from 0.20 to 0.28; and from 2 to 8 when the $Na_2CO_3$ concentration is from 0.18 to 0.36.

Another series of experiments was performed to investigate the effectiveness of using alternating slugs of sodium carbonate and sodium hydroxide solutions. Sodium carbonate was injected into the initial slug in each case. The results are shown in Table III immediately hereinafter below.

TABLE III

| $Na_2CO_3$ Conc. | NaOH Conc | Continuous Mixture Injection ($Na_2CO_3$/NaOH) | Residual Oil Saturation Alternating Slugs |
|---|---|---|---|
| 0.08% | 0.08% | 21.4% | 28.5% |
| 0.32% | 0.08% | 8.6% | 14.2% |
| 0.40% | 0.08% | 10.2% | 9.0% |
| 0.16% | 0.16% | 17.6% | 22.2% |
| 0.24% | 0.16% | 12.8% | 14.3% |
| 0.32% | 0.16% | 13.6% | 6.7% |
| 0.40% | 0.16% | 14.9% | 10.6% |

The alternating slug process is also an effective recovery process.

The foregoing data clearly establishes that the amount of oil recovered in a hot aqueous fluid oil recovery process can be significantly increased if the hot aqueous fluid contains a synergistic mixture of sodium carbonate or other buffering agent and sodium hydroxide or other alkalinity agent, in a critical concentration ratio.

While my invention has been described in terms of a number of illustrative embodiments, this is done in part for the purpose of complete disclosure and it is not intended to be in any way limitative or restrictive of the true spirit and scope of my invention, which will be described more precisely hereinafter below in the claims.

I claim:

1. A method for recovering petroleum from a subterranean, petroleum containing formation penetrated by an injection well in fluid communication with at least a portion of the oil formation and by a spaced-apart production well in fluid communication with at least a portion of the formation comprising injecting steam into the formation via said injection well, said steam comprising a vapor phase and a liquid phase, said phases separating with the vapor phase moving to the upper portion of the petroleum formation and the liquid phase moving to the lower portion of the petroleum formation, wherein the improvement for increasing the oil displacement effectiveness of the liquid phase component of the injected steam comprises contacting at least a portion of siad lower portion of formation with an aqueous fluid containing from 0.005 to 2.0 percent by weight sodium hydroxide and from 0.01 to 5.0 percent by weight sodium carbonate prior to the injection of steam.

2. A method as recited in claim 1 wherein the concentration of the sodium hydroxide is from 0.02 to 1.9 percent by weight.

3. A method as recited in claim 1 wherein the concentration of sodium carbonate is from 0.02 to 4.0 percent by weight.

4. A method for recovering petroleum from a subterranean, petroleum containing formation penetrated by an injection well in fluid communication with at least a portion of the petroleum formation and penetrated by a spcaed apart production well in fluid communication with at least a portion of the formation, comprisig injecting steam into the formation, said steam comprising a vapor phase and a liquid phase, said phases separting with the vapor phase moving to the upper portion of the formatiom, wherein the improvement for increasing the oil displacement effectiveness of the liquid phase component of the injected steam comprises incorporating from 0.005 to 2.0 percent by weight sodium hydroxide and from 0.01 to 5.0 percent by weight sodium carbonate in at least a portion of said steam, the ratio of sodium carbonate to sodium hydroxide being from 0.01 to 400.

5. A method as recited in claim 4 wherein the concentration of sodium hydroxide is from 0.01 to 1.9 percent.

6. A method as recited in claim 4 wherein the concentration of sodium carbonate is from 0.15 to 4 percent.

7. A method as recited in claim 4 wherein the ratio of sodium carbonate to sodium hydroxide is from 0.03 to 20.0.

* * * * *